United States Patent [19]

Salice

[11] 4,417,366

[45] Nov. 29, 1983

[54] HINGE BRACKET MOUNTING PLATE ASSEMBLY HAVING A SPRING BIASED LOCKING MECHANISM

[75] Inventor: Luciano Salice, Carimate, Italy

[73] Assignee: Arturo Salice S.p.A., Novedrate, Italy

[21] Appl. No.: 389,048

[22] Filed: Jun. 16, 1982

[30] Foreign Application Priority Data

Nov. 17, 1980 [DE] Fed. Rep. of Germany ..... 3043334

[51] Int. Cl.[3] ..... E05D 5/02; E05D 7/12

[52] U.S. Cl. ..... 16/258; 16/382; 16/DIG. 40

[58] Field of Search ..... 16/235, 242, 254, 257, 16/258, 382, 383, 387, DIG. 40; 248/225.4, 226.1

[56] References Cited

FOREIGN PATENT DOCUMENTS

| | | | |
|---|---|---|---|
| 2512656 | 9/1975 | Fed. Rep. of Germany | 16/382 |
| 2460127 | 6/1976 | Fed. Rep. of Germany | 16/235 |
| 2726671 | 1/1979 | Fed. Rep. of Germany | 16/235 |

*Primary Examiner*—Fred Silverberg

*Attorney, Agent, or Firm*—Morgan, Finnegan, Pine, Foley & Lee

[57] ABSTRACT

The mounting plate has a track for slidably guiding the hinge bracket in an axial direction and a bore for longitudinally slidably guiding a spring-loaded detent pin, which protrudes from the bore and is held captive therein by at least one stop in the surface defining the bore. The hinge bracket has a sloping surface, which is arranged to force the detent pin into the bore as the hinge bracket is slidably moved onto the mounting plate. The hinge bracket also has a surface which as the hinge bracket is pushed over the detent pin holds the latter in a depressed position until the detent pin snaps into a detent opening of the hinge bracket so that the latter is releasably fixed. A locking mechanism of the type used in retractable ball point pens is provided and is adapted to lock the detent pin in two different (partly extended and fully extended) positions. The pin is adapted to be moved from one of said positions to the other in that the detent pin is depressed into the bore and then released. The free end of the detent pin lies in the path of the sloping surface when the detent pin is in its partly extended position. The pin which has been depressed by the sloping surface is adapted to snap into the detent opening and to be urged in said detent opening by the spring toward its fully extended position.

8 Claims, 18 Drawing Figures

HINGE BRACKET MOUNTING PLATE ASSEMBLY HAVING A SPRING BIASED LOCKING MECHANISM

This invention relates to a hinge bracket mounting plate assembly, wherein the mounting plate has a track for slidably guiding the hinge bracket in an axial direction and a bore for longitudinally slidably guiding a spring-loaded detent pin, which protrudes from the bore and is held captive therein by at least one stop in the surface defining the bore, and wherein the hinge bracket has a sloping surface, which is arranged to force the detent pin into the bore as the hinge bracket is slidably moved onto the mounting plate, and the hinge bracket also has a surface which as the hinge bracket is pushed over the detent pin holds the latter in a depressed position until the detent pin snaps into a detent opening of the hinge bracket so that the latter is releasably fixed.

Snap action joints for fixing hinge brackets to mounting plates, e.g., to such plates which have already been mounted on carrying walls, are known in various designs. They permit a quick and simple mounting of furniture parts which have already been provided with hinges. In the usual practice, the hinge brackets are fixed by screws to the associated mounting plates. Whereas this is a simple operation it takes substantial time, e.g., where a door having a plurality of hinges is to be mounted. Besides, the work is rendered more difficult by the fact that the door must usually be held in position as the hinge brackets are fixed by the screws.

This disadvantage can be eliminated by the provision of snap joints between the hinge brackets and the mounting plates.

German Early Disclosure No. 25 12 656 discloses a hinge bracket-mounting plate assembly which is of the kind described first hereinbefore and in which the carrying wall is provided with a sleevelike receptacle, which constitutes the mounting plate and has tracks for the hinge bracket which is to be inserted. Either the hinge bracket or the sleevelike receptacle has detent openings and the respective other part is provided with spring-loaded detent pins, which fall into the detent openings as the hinge bracket is moved on the track. Sloping surfaces are provided for depressing the detent pins as the hinge bracket is inserted into the receptacle but said sloping surfaces cannot slidably move over the free ends of the detent pins if the latter protrude beyond the tapered surface. For this reason the detent pins are permitted to protrude from their guiding bores only to such an extent that the free end of the detent pins are engageable by the sloping surface as the hinge bracket is inserted into the receptacle. On the other hand, detent pins protruding only to such an extent may not ensure a reliable fixation of the hinge bracket to the mounting plate when the detent pins have snapped into the detent openings. If the detent pins protrude from the guide bores to a larger extent, it will be necessary to depress the detent pins as the hinge bracket is slidably mounted on the mounting plate so that the tapered surface will engage the free ends of the detent pins. This requirement renders the assembling work more difficult.

It is an object of the invention to provide in a hinge bracket-mounting plate assembly a snap joint which can easily be made and ensures a reliable connection between the parts.

In a hinge bracket-mounting plate assembly of the kind described first hereinbefore this object is accomplished in accordance with the invention in that a locking mechanism of the type used in retractable ball point pens is provided and is adapted to lock the detent pin in two different (partly extended and fully extended) positions, the detent pin is adapted to be moved from one of said positions to the other in that the detent pin is depressed into the bore and then released, the free end of the detent pin lies in the path of the sloping surface when the detent pin is in its partly extended position, and the detent pin which has been depressed by the sloping surface is adapted to snap into the detent opening and to be urged in said detent opening by the spring toward its fully extended position. The use of the locking mechanism in accordance with the invention permits the detent pin to be held in its partly extended position when the hinge bracket is to be connected to the mounting plate. In that position, the sloping surface will reliably engage and depress the detent pin so that the latter will be spring-urged to its fully extended position when the detent pin is in register with the detent opening. In the snap joint provided in accordance with the invention between the hinge bracket and the mounting plate, the detent pin can be locked in either of two positions. In its partly extended position, the hinge bracket can easily be inserted. In its fully extended position the detent pin will extend into the detent opening to a sufficiently large depth.

According to a preferred further feature of the invention the sliding movement of the hinge bracket on the track of the mounting plate is limited by a stop and the free end portion of the detent pin has a beveled or frustoconical or rounded surface which during the movement of the spring-loaded detent pin from its partly extended to its fully extended position engages the rim of the detent opening so that a counterstop carried by the hinge bracket is pushed into backlash-free engagement with the stop of the mounting plate. The snap joint disclosed in German Early Disclosure No. 25 12 656 has the disadvantage that a backlash of the detent pins in the detent openings cannot be avoided so that the parts connected by the hinges may be shaky. Such shakiness will be avoided by this feature of the invention in that the detent pin constantly exerts a lateral force on the rim of the detent opening so that the hinge bracket and the mounting plate will be forced against each other without backlash. Obviously the rounded or beveled portions of the detent pin must be so designed that they cannot extend entirely into the detent opening and that they can constantly apply a force on the rim of the detent opening.

According to a further preferred feature of the invention, a clearance-adjusting screw is provided, which is in threaded engagement with the hinge bracket and has an annular groove, which is guided by the edges of a slot in the mounting plate, and said groove has side faces overlapping the edges of said slot. The slot is suitably open at one end so that the groove of the adjusting screw can be inserted into the slot in a simple manner.

The track provided on the mounting plate consists suitably of longitudinal grooves, which are provided on opposite sides of the mounting plate, and the hinge bracket is suitably channel-shaped and has sliding lugs, which are angled inwardly from the ends of the legs of the bracket and adapted to enter said longitudinal grooves.

The stops and counterstops for locating the bracket and plate relative to each other may be constituted by the end faces of the longitudinal grooves and by those faces of the sliding lugs which face the end faces of said grooves.

According to a further preferred feature of the invention, the sliding lugs are guided in the longitudinal grooves in a major part of the length thereof with a backlash and the end portions of the longitudinal grooves are upwardly or downwardly inclined or curved to eliminate said backlash. When the sliding lugs enter the angled or curved end portions of the longitudinal grooves, the straight edges of the sliding lugs will engage the side faces of the longitudinal grooves and the resulting canting will eliminate any backlash.

An embodiment of the invention will now be explained more in detail with reference to the accompanying drawings, in which FIG. 1 is a longitudinal sectional view showing a mounting plate, FIG. 2 is a front elevation showing the mounting plate of FIG. 1, FIG. 3 is a top plan view showing the mounting plate of FIG. 1, FIG. 4 is a front elevation showing a hinge bracket which is adapted to be releasably locked to the mounting plate, FIG. 5 is a longitudinal sectional view showing the hinge bracket of FIG. 4, FIG. 6 is a top plan view showing the hinge bracket of FIG. 5, FIG. 7 is a side elevation showing the mounting plate and the hinge bracket, shown partly in a longitudinal sectional view, which has been pushed onto the mounting plate to a position in which the tapered surface of the hinge bracket has not yet reached the detent pin, which is in its partly extended position, FIG. 8 is a view similar to FIG. 7 and shows a position in which the cam formed with the sloping surface has depressed the detent pin, FIG. 9 is a view similar to FIGS. 7 and 8 and shows the hinge bracket and the mounting plate releasably locked to each other, FIG. 10 is a sectional view taken on line X—X in FIG. 11 which extends through that portion of the mounting plate that is provided with the bore for the detent pin, on the level of the surface provided with the guide ribs of the locking mechanism, FIG. 11 is a longitudinal sectional view taken on line XI—XI in FIG. 10 through the bore, FIG. 12 is a side elevation showing the spring-loaded slider of the locking mechanism, FIG. 13 is a bottom view showing the detent pin.

Figure 1:
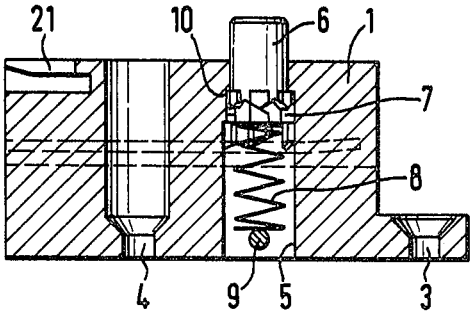
Figure 2:
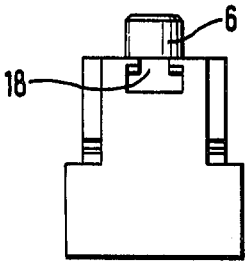
Figure 3:
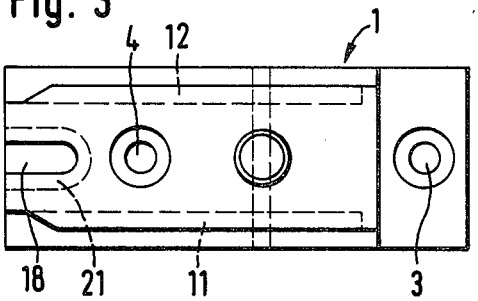

The mounting plate 1 is substantially parallel-epipedic and in its rear and front portions is formed with bores 3, 4 for fixing screws.

The middle portion of the mounting plate 1 has a bore 5, in which a detent pin 6 is longitudinally slidably guided. The detent pin 6 has a profiled inner end portion, which will be described more fully hereinafter and constitutes part of a locking mechanism of the type used in retractable ball point pens. That profiled inner end portion cooperates with beveled ribs of a slider 7, which is urged by a compression spring 8 towards the detent pin 6. That compression spring 8 bears at its bottom end on a crosspin 9, which extends through the bore 5. At its outer end the spring 8 bears on the slider 7. The surface of the bore 5 is also formed with ribs, which together with the profiled inner end portion of the detent pin 6 and the spring-loaded slider 7 constitute the locking mechanism, which will be described more in detail hereinafter and is of the type used in retractable ball point pens. The profiled inner end portion of the detent pin is larger in diameter than the body of the detent pin and thus forms shoulders, which cooperate with an annular shoulder 10 formed in the outer portion of the bore 5. That annular shoulder thus constitutes a stop, which defines the fully extended position of the detent pin 6 and prevents the latter from falling out of the bore 5. This locking mechanism ensures that the detent pin 6 when repeatedly depressed will be locked in a partly extended position and in a fully extended position in alternation.

The mounting plate 1 is provided on opposite sides with guiding grooves 11, 12 for sliding lugs 13, 14 framed on the hinge bracket 16. As is apparent from FIGS. 7 to 9, the forward portions 17 of the grooves 11, 12 are slightly upwardly inclined.

The rear end portion of the mounting plate 1 is provided on its outside surface with an opening 18, which is T-shaped in cross-section. The opening 18 is open at the rear and has a rounded forward end portion. The opening 18 constitutes a guide for an adjusting screw 20, which is in threaded engagement with the hinge bracket 16 and is formed with an annular groove 19. Adjacent to the opening 18, the mounting plate 1 is formed with edge strips 21, which overlap the opening 18 and have inside surfaces which together with the bottom of the opening 18 define guiding grooves. The end portions of the edge strips are beveled, as is shown in FIG. 1, in order to facilitate the insertion of the T-shaped end portion 22 of the adjusting screw 20 into the opening 18.

Figure 4:
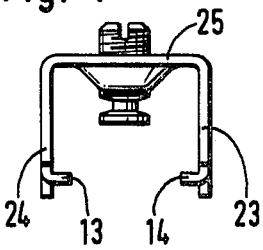

As is particularly apparent from FIG. 4, the hinge bracket 16 is channel-shaped and comprises flanges 23, 24, which are connected by a web 25. The forward portion of the hinge bracket 16 is formed with sliding lugs 13, 14, which are angled inwardly from the flanges 23, 24. The web 25 is formed with a punched bore 26, which is provided with a collar and with female screw threads for the adjusting screw 20.

Figure 5:
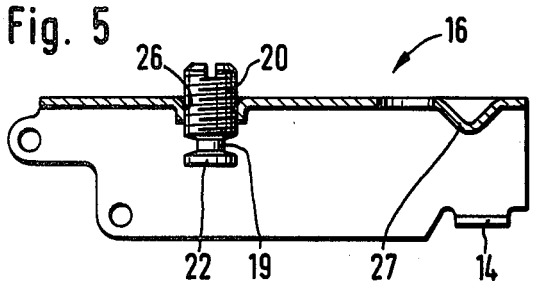
Figure 6:
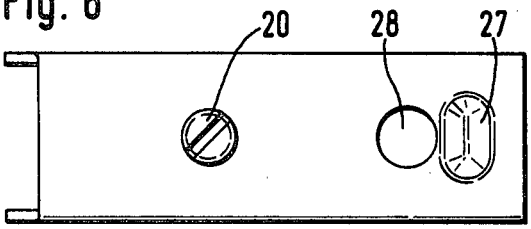

In the forward portion of the hinge bracket 16, its web 25 is formed with a cam 27, which is V-shaped, as is apparent from FIGS. 4 to 6. In a side elevation of the hinge bracket 16, as shown in FIG. 5, the cam 27 slopes on both sides like a pitched roof. Closely behind the cam 27 the web 25 is formed with a detent opening 28 for receiving the detent pin 6.

Figure 7:
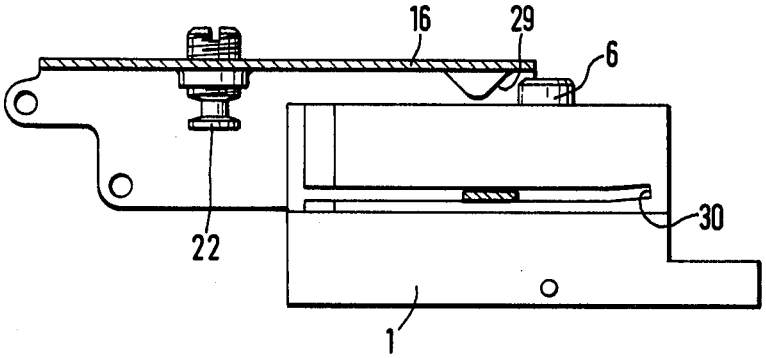
Figure 8:
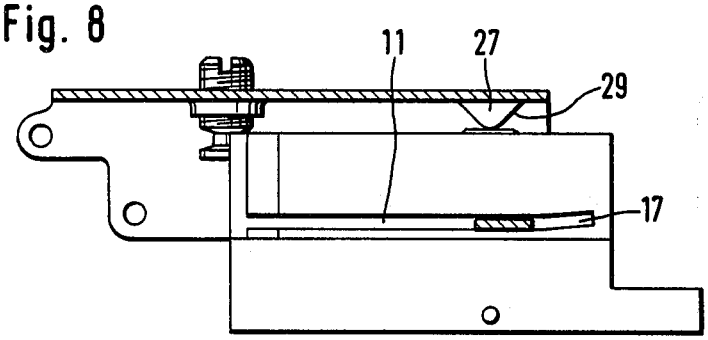
Figure 9:
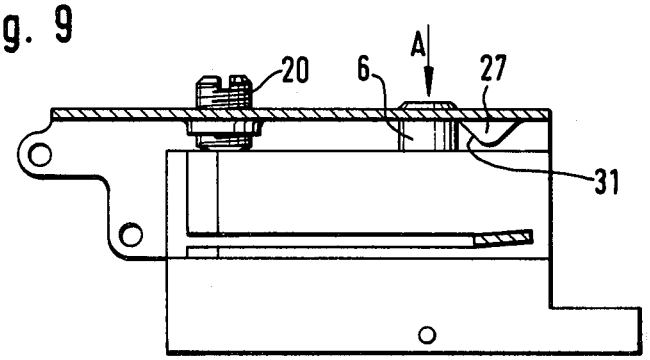

When it is desired to connect the hinge bracket 16 to the mounting plate, the sliding lugs 13, 14 are slidingly inserted into the guiding grooves 11, 12 of the mounting plate 1, as is apparent from FIGS. 7 to 9. To prevent an engagement of the leading edge of the web 25 with the detent pin 6 during such sliding movement, the detent pin 6 has previously been depressed so that it is held in its partly extended position, shown in FIG. 7, by the locking mechanism. In that position the outer end of the detent pin 6 is clear of the web 25. As the sliding movement of the hinge arm 16 is continued, the cam 27 moves past the detent pin 6 and the sloping forward face 29 of the cam 27 engages and depresses the detent pin 6, as is apparent from FIG. 8. During the continued movement of the hinge bracket 16, the cam 27 releases the detent pin 6 so that the latter is springurged toward its fully extended position. When the detent opening 28 then reaches the detent pin 6, the latter will snap into its fully extended, locking position when the detent opening and the bore for the detent pin are in registry.

During the sliding movement of the hinge bracket 16 on the mounting plate 1, the T-shaped end portion 22 of the adjusting screw 20 slides in the mating T-shaped guiding groove 18 of the mounting plate. Because the T-shaped end portion 22 is longitudinally slidable in the guiding groove 18 but is held therein against axial displacement, the adjusting screw 20 can be used to adjust the clearance between the hinge bracket and the mounting plate.

The guiding grooves 11, 12 of the mounting plate 1 are provided at their forward ends with stops 30, which are engaged by the forward sides of the sliding lugs 13, 14 when the parts are locked in the position shown in FIG. 9.

The sliding lugs 13, 14 are guided in the guiding grooves 11, 12 with a slight backlash. Because each guiding groove 11, 12 has a forward portion 17 which is slightly upwardly inclined, the sliding lugs 11, 12 will be canted and slightly deformed in that portion 17 and will thus be held in the groove without backlash when the parts are locked.

To release the hinge bracket from the mounting plate when the parts are locked in the position shown in FIG. 9, the detent pin 6 must be depressed in the direction of the arrow A so that it will then be locked by the locking mechanism in its partly extending position, in which the outer end of the detent pin 6 is clear of the web 25. The hinge bracket 16 can then easily be pulled from the mounting plate because the sloping rear face 31 of the cam 27 will depress the detent pin 6.

The locking mechanism of the type used in retractable ball point pens will now be explained more in detail with reference to FIGS. 10 to 18.

Figure 10:
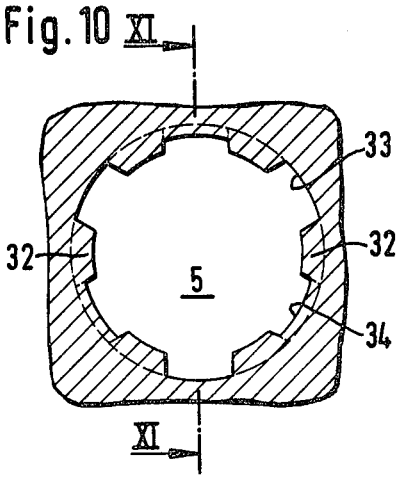
Figure 11:
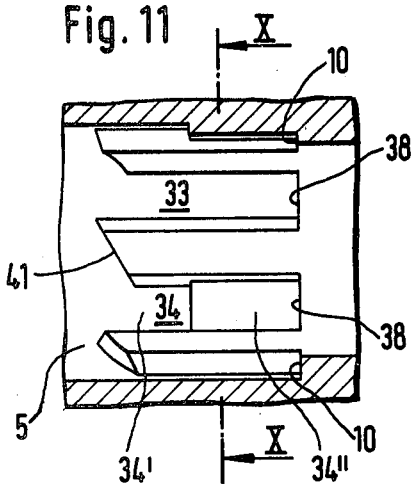

As is apparent from FIGS. 10 and 11, six axial guide ribs 32 are provided on the surface of the bore 5 and are equally angularly spaced apart. At their ends facing the abutment 9 for the compression spring 8, the ribs 32 have end faces sloping in the same sense. Grooves 33 and 34 are defined in alternation between adjacent ribs 32. The grooves 33 have a larger depth throughout their length than the grooves 34 and the bottom of each groove 33 is defined by the radius of the bore 5. Axially outwardly of the grooves 33, the bore 5 has a portion which is smaller in diameter and which has the same radius as the crests of the ribs 32.

Each groove 34 is stepped in depth and has an inlet portion 34', which has the same depth as the grooves 33, and an adjoining portion 34'' of smaller depth.

Figure 13:
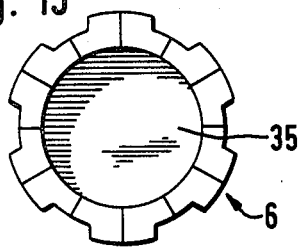
Figure 15:
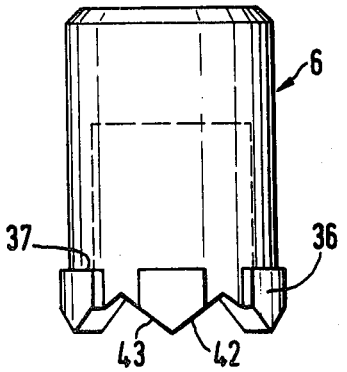
FIG. 15 is a side elevation showing the detent pin of FIG. 13.

The detent pin 6 shown in FIGS. 13 and 15 has a central blind bore 35 and at the rim of said bore is formed with six ribs 36, which protrude radially outwardly from the body of the detent pin 6 and have the same width as the grooves 33, 34. The axially outer end faces of the ribs 36 constitute shoulders or stops 37. The ribs 36 are guided in the grooves 33 and 34 and have such a radial extent that they can move also in the shallower portions 34'' of the grooves 34 until the shoulders 37 engage the end faces 38 of the grooves 33, 34.

Figure 12:
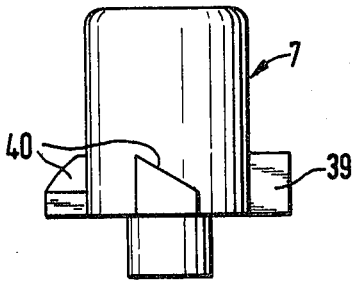
Figure 14:
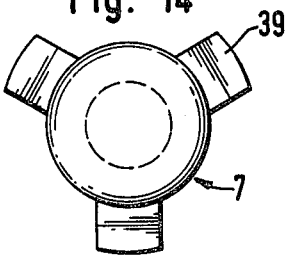
FIG. 14 is a top plan view showing the slider of FIG. 12.

The slider 7 shown in FIGS. 12 and 14 is cylindrical and is so large in diameter that the slider 7 can be slidably inserted into the bore 35 of the detent pin 6 but will not bear on the bottom of the bore 35. The slider 7 is provided with three radially outwardly protruding ribs 39, which are equally angularly spaced apart and have end faces 40 sloping in the opposite sense of the end faces 41 of the ribs 32. The ribs 39 have such a radial extent that they can slide over the bottom of the grooves 33 but can slide only in the deeper portion 34' of each groove 34. In the grooves 34, the ribs 39 will engage the shoulder between the portions 34' and 34''.

The bore 35 in the detent pin 6 is surrounded at its open end by an end face consisting of sloping surfaces 42, 43, which are defined by a zig-zag line. Two surfaces 42, 43 sloping in opposite senses meet at the center line of each rib 36. The surfaces 42, 43 slope at the same angle as the sloping end faces 41, 40.

The mode of operation of the locking mechanism of the type used in retractable ball point pens will now be explained more in detail with reference to FIGS. 16 to 18, where lines provided with no reference characters indicate the ribs in the bore 5 in a developed view. The zig-zag line marked with short strokes represents a developed view of the toothed edge of the detent pin 6. Hatched areas represent the ribs 39 of the slider 7 in section.

Figure 16:
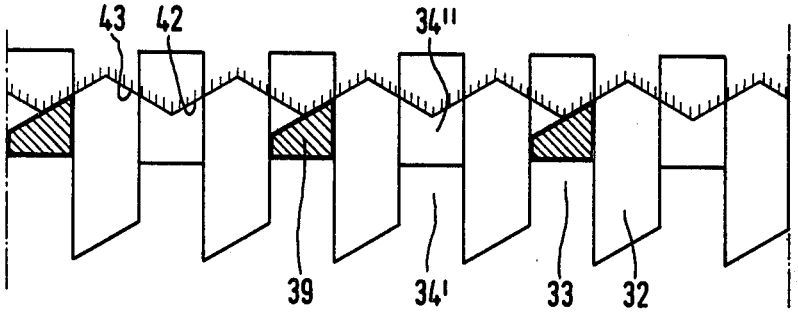
FIGS. 16 to 18 are developed views showing the ribbed surface of the bore and the profiled side portions of the spring-loaded slider and the detent pin when the latter is in its fully extended and partly extended positions, respectively.

In FIG. 16 the locking mehanism is shown in the position assumed when the spring-loaded detent pin 6 is in its fully extended position, in which the ribs 39 bear on the right-hand sloping surfaces at the rim of the detent pin 6 so that the shoulders 37 of the ribs 36 will be urged against the end faces 38 of the grooves 33, 34.

Figure 17:
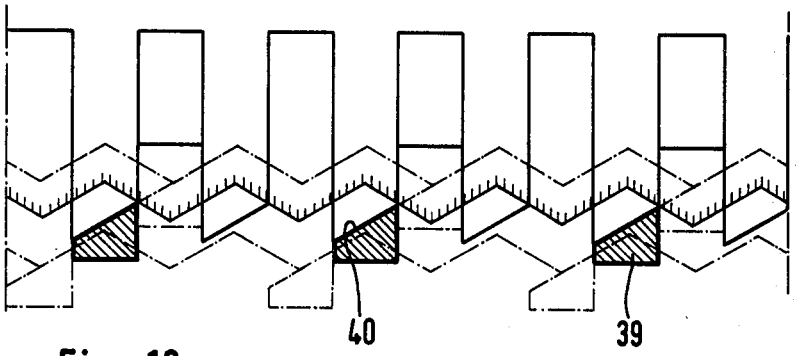

When axial pressure is then applied to the detent pin 6 in the manner indicated in FIG. 17, the detent pin 6 will move the slider 7 in the grooves 33 against the force of the spring 8 until the axially inner end faces of the ribs 39 have moved past the axially inner ends of the ribs 32. When the ribs 39 have thus been moved out of the grooves 33, the sloping surfaces 40 will slide on the sloping end faces 42 of the ribs 36 of the detent pin 6 until the axially inner end faces of the ribs 39 engage the oppositely sloping surfaces 43. As the sloping surfaces slide on each other, the slider 7 is rotated. When the detent pin is subsequently released, the sloping surfaces 40 will slide on the sloping end faces 41 of the ribs 32 until the ribs 39 snap into the grooves 34, in which the axially outward movement of the ribs 36 of the detent pin 6 is limited by the engagement of the axially outer end of each rib 39 with the shoulder between the portions 34' and 34'' of different depths.

Figure 18:
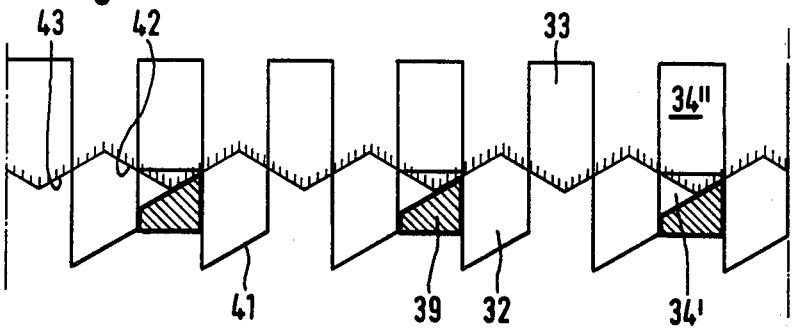

This position of the detent pin 6 and the slider 7 is apparent from FIG. 18.

What is claimed is:

1. A hinge bracket-mounting plate assembly, wherein the hinge bracket-mounting plate assembly comprises a mounting plate, wherein the mounting plate has a track for slidably guiding the hinge bracket in an axial direction and a bore for longitudinally slidably guiding a spring-loaded detent pin, said detent pin includes a free end and protrudes from the bore and is held captive therein by at least one stop in the bore, and wherein the hinge bracket has a first sloping surface arranged to force the detent pin into the bore as the hinge bracket is slidably moved onto the mounting plate, and the hinge bracket also has a second sloping surface which as the hinge bracket is pushed over the detent pin holds the detent pin in a depressed position until the second sloping surface slides past the detent pin, the detent pin then snaps into a detent opening in the hinge bracket so that the detent pin is releasably fixed, said hinge bracket-mounting plate assembly having a locking mechanism of the type used in a retractable ball point pen, said locking mechanism comprising the spring loaded detent pin and a slider, said locking mechanism is adapted to lock the detent pin in two different positions, said positions including a partly extended position and a fully extended position so that the detent pin is moved from one of said positions to another of said positions when the detent pin is depressed into the bore and then released, the free end of the detent pin lies in the path of the first sloping surface when the detent pin is in the partly extended position, and the detent pin which has been depressed by the first sloping surface snaps into the detent opening and is urged into said detent opening by the spring toward the fully extended position after the second sloping surfaces slides past the detent pin.

2. A hinge bracket-mounting plate assembly according to claim 1, characterized in that the first and second sloping surface is constituted by a roof-shaped cam, which has sloping surfaces comprises a roof-shaped cam.

3. A hinge bracket-mounting plate assembly according to claim 1, wherein the slidably moved hinge bracket is limited by stops and the free end portion of the detent pin has a surface which during the movement of the spring-loaded detent pin from the partly extended to the fully extended position engages a rim of the detent opening so that counterstops carried by the hinge bracket are pushed into backlash-free engagement with the stops of the mounting plate.

4. A hinge bracket-mounting plate assembly according to claim 3 wherein a clearance-adjusting screw is provided in threaded engagement with the hinge bracket and has an annular groove, is guided by edges of a slot in the mounting plate, and said groove has side faces overlapping the edges of said slot.

5. A hinge bracket-mounting plate assembly according to claim 4, wherein the slot is open at one end.

6. A hinge bracket-mounting plate assembly according to claim 5, wherein the track provided on the mounting plate comprises longitudinal grooves, said longitudinal grooves, are provided on opposite sides of the mounting plate, and the hinge bracket is channel-shaped and has sliding lugs, said lugs are angled inwardly from the ends of the legs of the bracket and adapted to enter said longitudinal grooves.

7. A hinge bracket-mounting plate assembly according to claim 6, wherein the stops are constituted by the end faces of the longitudinal grooves and the counterstops are constituted by the surfaces of the sliding lugs which face the stops.

8. A hinge bracket-mounting plate assembly according to claim 7, wherein the sliding lugs are guided in the longitudinal grooves in a major part of the length thereof with a backlash and the end portions of the longitudinal grooves are inclined to eliminate said backlash.

* * * * *